United States Patent [19]

Ketterer

[11] Patent Number: 4,537,448

[45] Date of Patent: Aug. 27, 1985

[54] EXCAVATING HEAD WITH PICK-CONTROLLED WATER SUPPLY

[75] Inventor: Klaus Ketterer, Krefeld, Fed. Rep. of Germany

[73] Assignee: Voest Alpine AG, Linz, Austria

[21] Appl. No.: 550,939

[22] Filed: Nov. 10, 1983

[30] Foreign Application Priority Data

Nov. 13, 1982 [DE] Fed. Rep. of Germany ..... 3242137

[51] Int. Cl.[3] ..... E21C 35/22

[52] U.S. Cl. ..... 299/81

[58] Field of Search ..... 299/81, 85, 86, 17

[56] References Cited

U.S. PATENT DOCUMENTS

| | | | |
|---|---|---|---|
| 3,747,982 | 7/1973 | Agnew et al. | 299/81 |
| 4,049,318 | 9/1977 | Fruin | 299/81 |
| 4,405,178 | 9/1983 | Brandenburg | 299/81 |
| 4,456,306 | 6/1984 | Wrulich et al. | 299/81 |

FOREIGN PATENT DOCUMENTS

| | | | |
|---|---|---|---|
| 0010534 | 7/1979 | European Pat. Off. . | |
| 2854307 | 7/1980 | Fed. Rep. of Germany | 299/81 |
| 621873 | 8/1978 | U.S.S.R. | 299/81 |
| 685821 | 9/1979 | U.S.S.R. | 299/86 |

*Primary Examiner*—James A. Leppink
*Assistant Examiner*—Hoang C. Dang
*Attorney, Agent, or Firm*—Karl F. Ross; Herbert Dubno

[57] ABSTRACT

A rotary excavating head is provided with a plurality of peripherally spaced tool holders supporting respective picks, each pick having a shank which is rotatable about its own axis and limitedly shiftable within a socket formed by the respective tool holder. A space of variable volume, formed between the shank end and the bottom of the socket, communicates via a check valve with a source of water whose supply pressure urges the pick outward, this space opening onto a restricted passage that terminates at a nozzle through which the water is sprinkled onto a mine face or tunnel wall attacked by the head when the respective pick is forced back against the water pressure by its encounter with the mineral matter to be fragmented. The restricted passage may include a pressure-relief valve; the nozzle may be constituted by a narrow annular clearance separating the shank of the pick from the cylindrical wall of the socket.

10 Claims, 3 Drawing Figures

EXCAVATING HEAD WITH PICK-CONTROLLED WATER SUPPLY

FIELD OF THE INVENTION

My present invention relates to a rotary excavating head, e.g. as used in mining or tunneling operations, with tool holders for the support of respective picks with cutting tips positioned for intermittent engagement with a body of coal, ore, rock or other mineral matter to be fragmented.

BACKGROUND OF THE INVENTION

Peripherally spaced tool holders of an excavating head of the type here considered, e.g. as illustrated in U.S. Pat. No. 3,747,982, are provided with sockets in which the shanks of respective tools or picks are removably received; the holders may be welded onto the body of the rotary head. The shanks may be rounded or flat, depending on whether or not the picks should be free to rotate about their own axes. Such rotatability is desirable for a substantially uniform all-around wear of their cutting tips; the latter usually consist of hard metal and have substantially frustoconical working edges. When that wear becomes excessive, the picks can be extracted from their sockets and replaced by fresh ones.

The recurrent encounter of a given pick with the mineral matter to be fragmented, e.g. at a mine face, subjects its shank to considerable stresses which also act upon the surrounding socket wall. These stresses may lead to deformations preventing further rotation of the shank in its socket so that the cutting tip of the pick begins to wear unsymmetrically and deteriorates more rapidly. Such a blocking of rotation can also be the result of comminuted matter penetrating into and becoming wedged in the narrow annular gap which separates the shank from the socket wall.

As known in the art, the tips of the picks as well as the mine face or other mineral formation attacked thereby ought to be cooled by a water spray during excavation. Such a spray also serves for the preceipitation of coal dust or the like developing during fragmentation and facilitates the removal of detritus from the site. For economic reasons, and to simplify the recovery of valuable minerals such as coal by avoiding the need for a separate drying step, it is desirable to hold the water supply within moderate limits. Thus, rotary heads with picks projecting parallel to the axis of rotation have been provided in the past with valves which block the flow as long as the picks are not in contact with a mine face. The valve responds to pressure exerted in the direction of that axis and this unblocks the flow intermittently as the tool is progressively advanced.

With tool heads having generally tangentially oriented picks, to which my invention is applicable, such a control cannot be used since the picks are not shiftable in the direction of advance. Moreover, each individual pick comes into working contact with the mine face only during part of a revolution. The picks, therefore, need not be supplied with water during their nonworking phases. For this purpose it is known, e.g. as noted in the aforementioned U.S. Pat. No. 3,747,982, to control the water supply by means of a distributor cutting off the flow to a segment remote from the mine face, yet this will not prevent the unneeded emission of water from an opposite segment when the picks thereof are not in contact with the mine face. From European Pat. specification 10,534 it is known to control the water supply to respective nozzles by valves that are opened by adjoining picks when the latter are repressed in their holders against countervailing spring forces.

OBJECTS OF THE INVENTION

An object of my present invention is to provide an excavating head of the type referred to with means for more effectively controlling the supply of water in accordance with the activity of each pick.

Another object is to provide simple means within each tool holder of such an excavating head for intensifying the pressure with which the water is dispensed therefrom, thus avoiding the need for high-pressure conduits between the water source and the tool holders as well as the problems of sealing such conduits against the outside.

A more particular object is to prevent, especially in the case of picks with rotary shanks, the intrusion of particles into the gaps between the shanks and the sockets which could block the rotatability of the picks about their respective axes.

SUMMARY OF THE INVENTION

In accordance with my present invention, the shanks of the picks supported by respective tool holders on a rotary head are received in their sockets with limited linear mobility, each shank being separated from the bottom of the associated socket by an intervening space of variable volume which has an inlet port communicating with a source of water whose pressure urges the shank linearly outward. This intervening space further has an outlet port which opens via a restricted passage onto a nozzle disposed in the vicinity of the respective cutting tip, either on the pick itself or at an adjoining location on an outer surface of the tool holder. The inlet port is provided with blocking means preventing the return of water from the intervening space to the source whereby the water trapped in that space is ejected under increased pressure through the associated nozzle upon inward repression of the shank by contact of the respective cutting tip with the mineral matter being fragmented.

The blocking means may be a check valve disposed, advantageously, in a recess on a face of a plug screwed into a threaded aperture at the bottom of the socket, the recess (which constitutes the aforementioned inlet port) being part of a channel through which water from the source is admitted into the intervening space. The channel may be partly in the shape of an annular groove on an outer surface of the plug which communicates with the recess via a bore of that plug.

The passage linking the outlet port of the intervening space with the associated nozzle can be restricted in various ways in order to throttle or block an outflow of water in the absence of pressure exerted on the pick by encountered mineral matter. Thus, I may provide that passage with a pressure-relief valve which remains closed as long as only the supply pressure prevails in the water-filled space. The restricted passage may also be formed, in the case of a pick with a cylindrical shank rotatable about its own axis, by the narrow annular clearance separating that shank from the socket wall in which case the mouth of the clearance acts as the nozzle. In other instances the passage may extend within the shank or alongside same in the socket-forming tool holder.

BRIEF DESCRIPTION OF THE DRAWING

The above and other features of my invention will now be described in detail with reference to the accompanying drawing in which.

SPECIFIC DESCRIPTION

Figure 1:
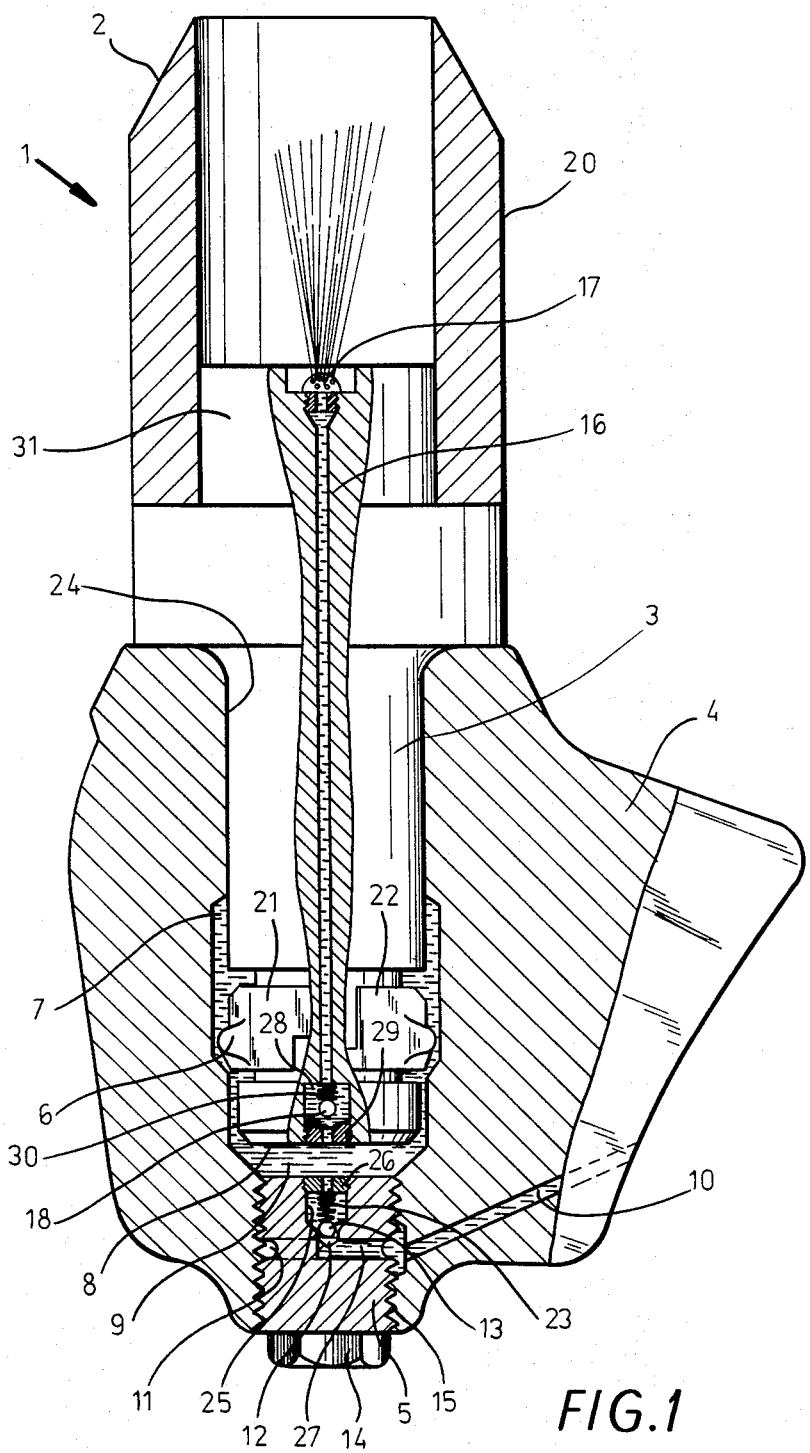
FIG. 1 is a fragmentary cross-sectional view of a tool holder provided with a pick embodying this invention.

FIG. 1 shows a holder 4 carried by a rotary excavating head not further illustrated. Several such holders are peripherally distributed about the rotary head and form respective sockets 24 each designed to receive a cylindrical shank 3 of a generally tangentially projecting tool or pick 1, e.g. as shown in U.S. Pat. No. 3,747,982 referred to above. The pick includes a cutting tip 20 of hard metal, designed as a sleeve surrounding an extremity 31 of shank 3, which has a frustoconical working edge 2. The inserted end of shank 3 has a reduced portion bracketed by approximately semicylindrical resilient clips 21 and 22 which have projections 6 engaging in an annular recess 7 of socket 24, thereby limiting the linear mobility of pick 1 to a fraction of the length of the shank. The bottom of socket 24 is provided with a threaded aperture 15 into which a plug 5 with a hexagonal head 14 has been screwed. Removal of this plug facilitates a disengagement of the pick 1 from tool holder 4, preparatorily to its extraction therefrom, through insertion of a suitable implement into the aperture 15 by which the clips 21, 22 can be retracted inward; the clips are accessible to such an implement by way of recess 7 when the shank 3 is moved to the outer limit of its stoke.

Plug 5 is separated from the free end 8 of shank 3 by an intervening space 9 whose volume varies with the position of that shank in socket 24. The face of the plug confronting the space 9 is formed with a recess 25 closed by a perforated nut 26 which holds in position a check valve comprising a ball 13 urged by a spring 23 against a seat 12. The recess and its seat form part of a water-supply channel which further includes a conduit 10 in holder 4, an annular groove 11 on the periphery of plug 5 and a radial bore 27 linking that groove with seat 12. Water from a nonillustrated source, which may be common to all the tool holders 4 of the excavating head, passes through the central perforation of nut 26 into the space 9. The end face of shank 3 also has a recess 28 closed by a perforated nut 29 which forms a seat for a ball 18 of a pressure-relief valve provided with a biasing spring 30. The recess 28 opens into a passage 16 extending axially within shank 3 to a nozzle 17 disposed at an opposite face of the shank within the cutting tip 20.

When the pick 1 is idle, the supply pressure of the water accumulating in space 9 forces it lineraly outward so that this space expands to its maximum volume. This supply pressure is sufficient to open the check valve 13, 23 but does not overcome the force of spring 30 whereby passage 16 remains blocked by the ball 18 in this position. When the pick comes into contact with solid rock or the like at a mine face or a tunnel wall, for example, the resistance of that mineral matter forces the pick back with resulting constriction of space 9. Since the water present in that space is prevented by ball 13 from returning to the source, its hydrostatic pressure increases and forces the ball 18 off its seat whereby nozzle 17 emits a spray through the open end of cutting tip 20 and onto the inner wall of that tip for effectively cooling same. Naturally, the maximum volume of space 9 should be such that the amount of water accumulated therein during an idling phase is sufficient to irrigate the cutting tip as well as the confronting mineral formation and detached fragments during the entire working phase which may be somewhat less than half a revolution of the head about its axis.

Figure 2:
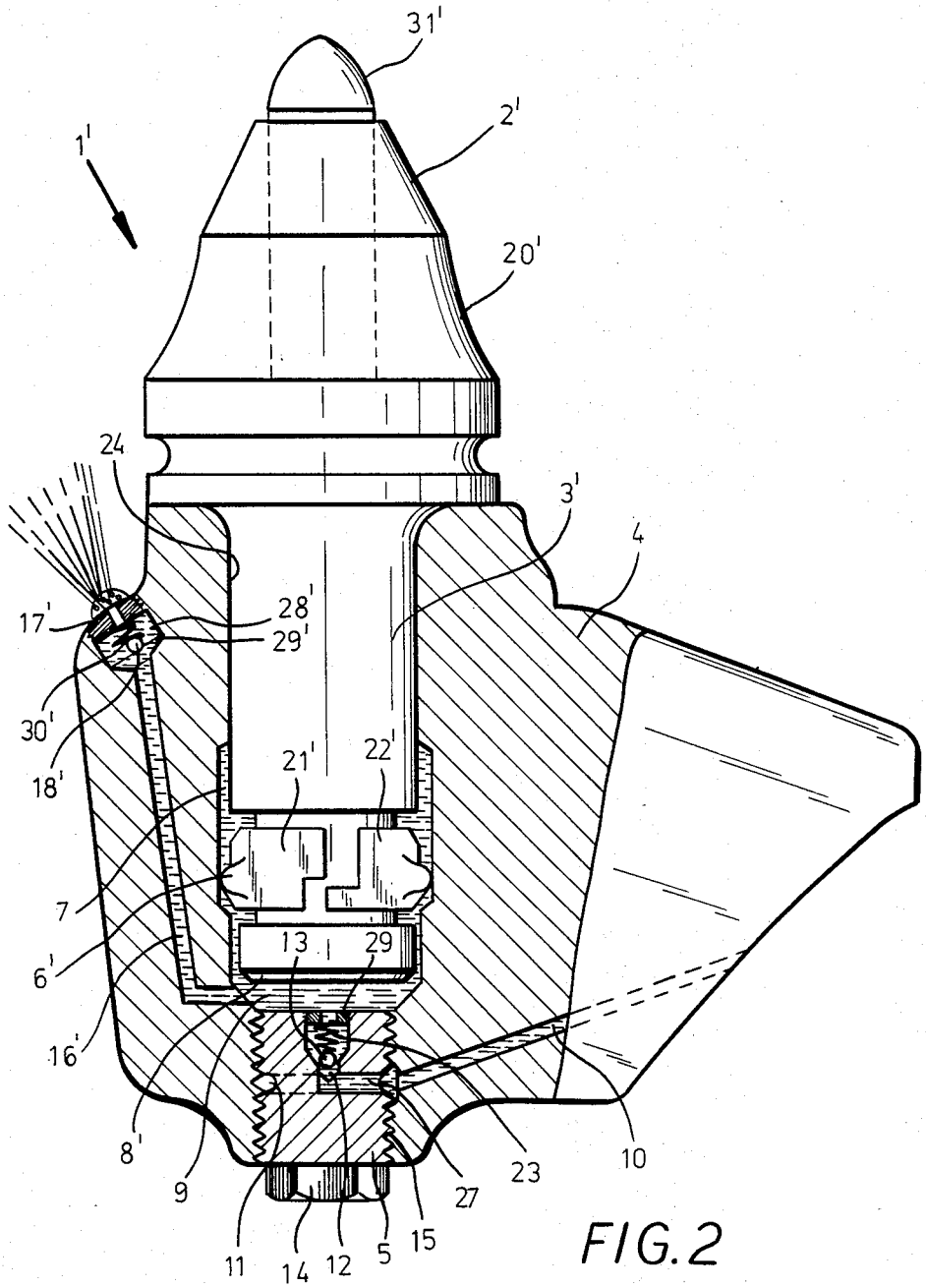
FIGS. 2 and 3 are views similar to that of FIG. 1, illustrating respective modifications.

In FIG. 2 I have shown a modified pick 1′ whose cutting tip 20′ with working edge 2′ is fitted onto a solid extremity 31′ of a shank 3′ received as before in a socket 24 of a tool holder 4, the shank being retained in that socket by projections 6′ on clips 21′ and 22′ similar to those described above. The free end 8′ of shank 3′ lacks the recess 28 of the preceding embodiment while a passage 16′ extends from a converging inner part of space 9 through holder 4 alongside socket 24 to a recess 28′ formed at the outer surface of that holder. Recess 28′ contains a pressure-relief valve with a ball 18′ urged by a spring 30′ against a seat 29′ at the outlet end of passage 16′. Spring 30′ is confined by a nozzle-forming nut 17′ threaded into recess 28′ .

In a mode of operation analogous to that described with reference to FIG. 1, the supply pressure of water fed via check valve 13, 23 into space 9 is insufficient to lift the ball 18′ of the pressure-relief valve off its seat 29′. When, however, pick 1′ is repressed by its encounter with solid rock or other mineral matter from its extended position toward its illustrated retracted position, with consequent increase in the hydraulic pressure of space 9, water expelled from that space will form a spray emitted by nozzle 17′ after overcoming the resistance of biasing spring 30′. With nozzle 17′ disposed radially outwardly of the pick 1′ which points in the direction of rotation, the water spray will partly fall on the pick itself and partly cool an area of the confronting rock formation just worked on by the edge 2′ of that pick.

Figure 3:
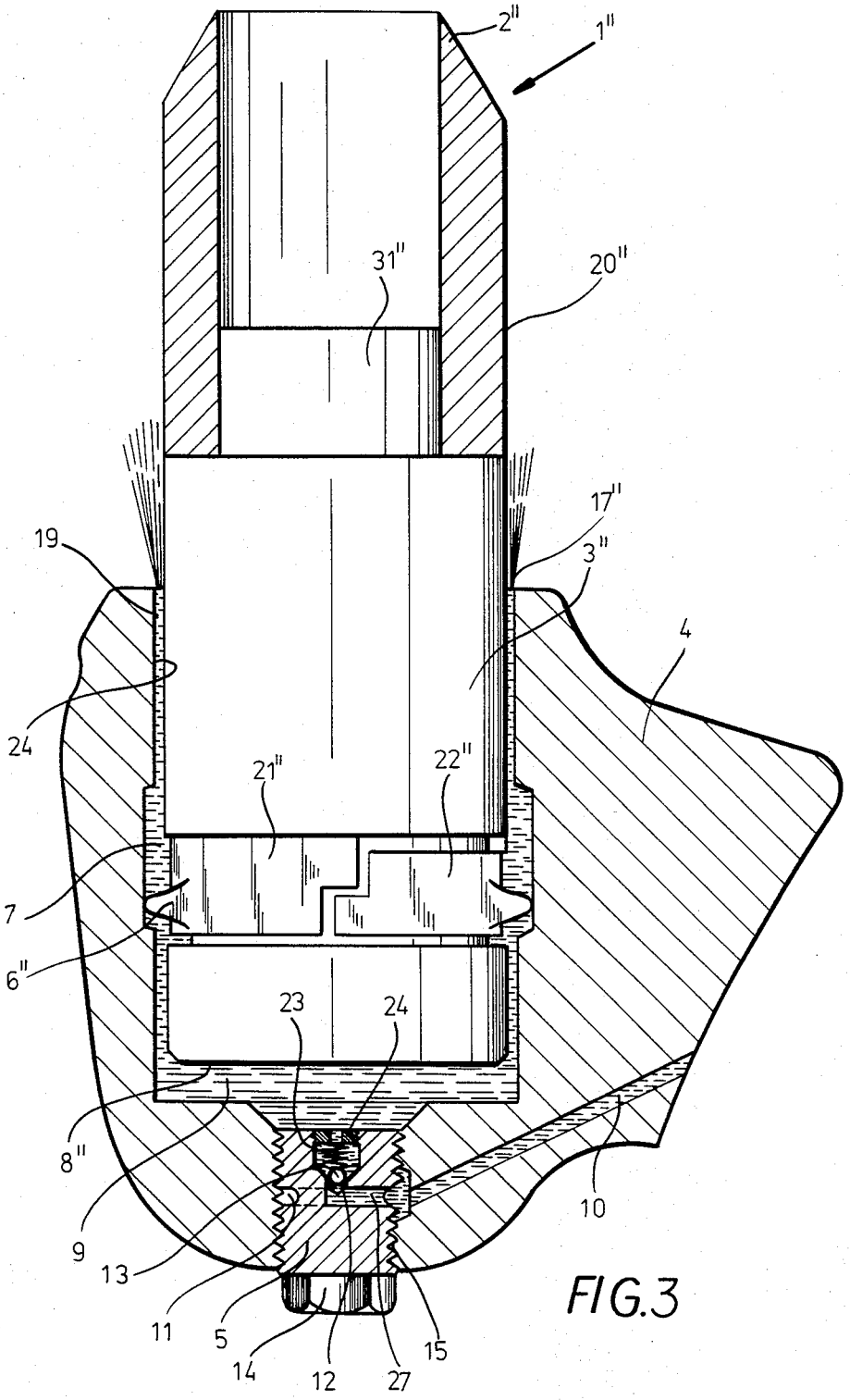

In both FIG. 1 and FIG. 2 the shanks 3, 3′ rotatably received in sockets 24 are separated from the socket walls by a very narrow gap through which a small proportion of the water pressurized in space 9 will penetrate to sweep same clear of solid particles and lubricate the shanks while exerting an additional retarding effect upon their inward motion. In FIG. 3, however, I have shown an embodiment in which a shank 3″ of a pick 1″ is received with a somewhat wider annular clearance 19 in a socket 24 of a holder 4, this clearance extending past the recess 7 to the free end 8″ of the shank which again lacks the recess 28 of FIG. 1. Shank 3″, indexed as before in holder 4 by projections 6″ of resilient clips 21″ and 22″, has a diameter corresponding to the outer diameter of a cutting tip 20″ with working edge 2″ which is fitted onto an extremity 31″ of the shank in the same manner as in FIG. 1. Clearance 19 forms a throttled flow path whose resistance, like that of pressure-relief valves 18, 30 and 18′, 30′ of the preceding Figures, substantially prevents the passage of water under supply pressure from space 9 to a spray nozzle here constituted by the mouth 17″ of that clearance. Thus, a water spray issuing from mouth 17″ will surround the pick 1″ only when the same is being repressed by an encounter of its working edge 2″ with mineral matter attacked by the pick. The water, of course, will also sweep the clearance 19 clean of solid particles and exert a motion-retarding effect upon the shank 3″ as discussed above.

I claim:

1. A rotary excavating head carrying tool holders in which picks with cutting tips are positioned for intermittent engagement with a formation of mineral matter to be fragmented, each of said picks having a shank received with limited linear mobility in a socket of the respective tool holder, said shank being separated from the bottom of said socket by a space of variable volume having an inlet port communicating with a source of water under supply pressure urging said shank linearly outward, said space further having an outlet port opening via a restricted passage onto a nozzle disposed in the vicinity of the respective cutting tip, said inlet port being provided with blocking means preventing a return of water from said space to said source whereby the water trapped in said space is ejected under increased pressure through said nozzle upon linear inward repression of said shank by contact of the respective cutting tip with said mineral matter.

2. An excavating head as defined in claim 1 wherein said shank and said socket are cylindrical, said shank being freely rotatable in said socket about a substantially radial axis.

3. An excavating head as defined in claim 2 wherein said nozzle is formed by a mouth of a narrow annular clearance separating said shank from a surrounding wall of said socket.

4. An excavating head as defined in claim 1 wherein said cutting tip is a sleeve of hard metal surrounding a reduced extremity of said shank.

5. An excavating head as defined in claim 4 wherein said restricted passage extends within said shank toward said nozzle, the latter being located inside said sleeve.

6. An excavating head as defined in claim 1 wherein said restricted passage extends alongside said shank to an outer surface of said tool holder, said nozzle being located at said outer surface.

7. An excavating head as defined in claim 1 wherein said restricted passage is provided with a pressure-relief valve blocking an outflow of water from said space into said nozzle in the absence of pressure exerted upon said pick by an encounter of said cutting tip with said mineral matter.

8. An excavating head as defined in claim 1 wherein said blocking means comprises a check valve.

9. An excavating head as defined in claim 8 wherein the bottom of said socket is provided with a threaded aperture closed by a plug screwed into same, said plug having a channel forming said inlet port and containing said check valve.

10. An excavating head as defined in claim 9 wherein said channel is partly in the shape of an annular groove on an outer surface of said plug, said inlet port being a recess in a face of said plug confronting said space, said groove communicating via a bore with said recess.

* * * * *